US005238199A

United States Patent [19]

Ossoinig et al.

[11] Patent Number: 5,238,199

[45] Date of Patent: Aug. 24, 1993

[54] ARRANGEMENT TO BE USED FOR LAYING A WIRE IN CIRCULAR WINDINGS

[75] Inventors: Walter Ossoinig, Linz; Günter Prinz, Steyr; Ernst Schandl, Linz; Alois Stadlbauer, Linz; Klaus Zeman, Linz, all of Austria

[73] Assignee: Voest-Alpine Industrieanlagenbau G.m.b.H., Linz, Austria

[21] Appl. No.: 793,599

[22] Filed: Nov. 18, 1991

[30] Foreign Application Priority Data

Nov. 20, 1990 [AT] Austria ..... 2347/90

[51] Int. Cl.[5] ..... B21C 47/14

[52] U.S. Cl. ..... 242/82; 57/311

[58] Field of Search ..... 242/82, 83; 57/311, 57/313, 341, 342, 343, 344

[56] References Cited

U.S. PATENT DOCUMENTS

| | | | |
|---|---|---|---|
| 1,744,619 | 1/1930 | Courcy | 57/341 X |
| 2,900,073 | 8/1959 | Blake et al. . | |
| 3,503,200 | 3/1970 | Roberts et al. | 57/311 |
| 3,719,035 | 3/1973 | Gilchrist | 57/341 |
| 4,765,556 | 8/1988 | Nasrah | 242/82 |

FOREIGN PATENT DOCUMENTS

| | | |
|---|---|---|
| 845188 | 7/1952 | Fed. Rep. of Germany . |
| 2912162 | 10/1980 | Fed. Rep. of Germany . |
| 1313211 | 11/1962 | France . |
| 109329 | 11/1974 | German Democratic Rep. . |

OTHER PUBLICATIONS

Patent Abstracts of Japan vol. 14, No. 231 (M-97), May 16, 1990 & JP-A-2 059 115 (Sumitomo Electric Ind. Ltd.) Feb. 28, 1990.

Patent Abstracts of Japan vol. 11 No. 388 (M-652), Dec. 18, 1987 & JP-A-62 157 178 (Suekichi Sadotomo) Jul. 13, 1987.

Patent Abstracts of Japan vol. 12, No. 78 (M-675), Mar. 11, 1988 & JP-A-62 220 218 (Nippon Steel Weld Prod. & Eng. Co. Ltd.) Sep. 28, 1987.

*Primary Examiner*—John M. Jillions

*Attorney, Agent, or Firm*—Hopgood, Calimafde, Kalil, Blaustein & Judlowe

[57] ABSTRACT

An arrangement for laying a wire in circular windings by bending the wire to circular form during simultaneous twisting includes a wire conveying device and a consecutively arranged laying head including a rotating laying pipe, whose central axis is oriented tangentially to the wire axis on the wire entry end and which gradually passes from the entry end into a circular arc directed approximately perpendicular to the axis of rotation, its center lying on the axis of rotation. A twisting device is provided between the wire conveying means and the laying head. In order to be able to lay wires of larger diameters in closely adjacent windings, the twisting device is formed by a bent pipe twisting the wire under positive locking and frictional engagement.

12 Claims, 1 Drawing Sheet

ARRANGEMENT TO BE USED FOR LAYING A WIRE IN CIRCULAR WINDINGS

Figure 1:
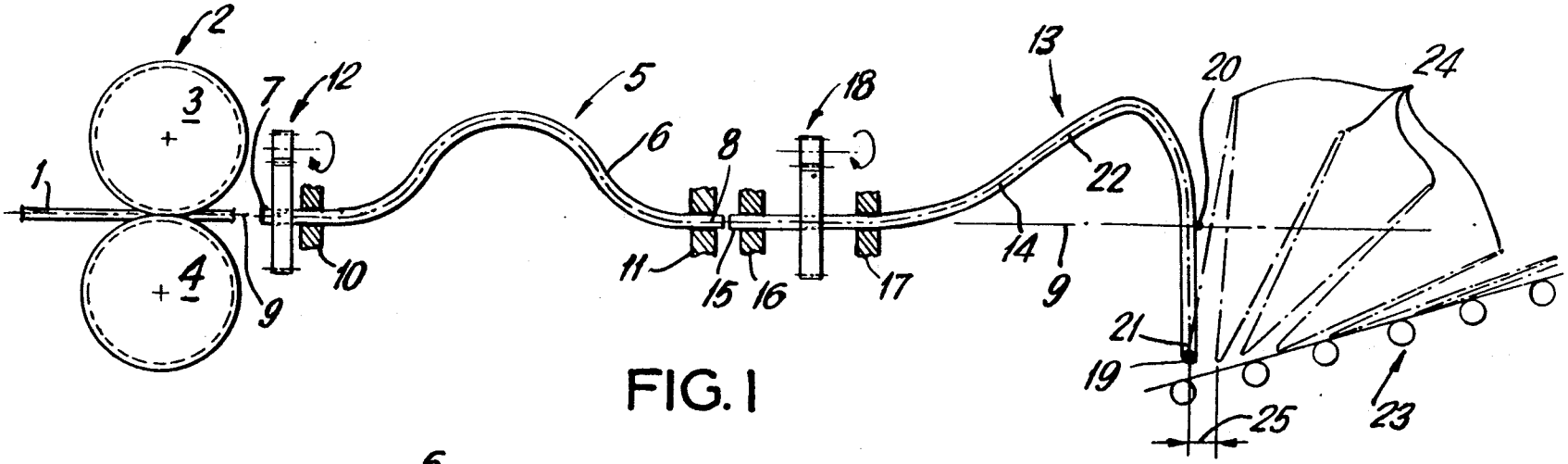

The invention relates to an arrangement for laying a wire in circular windings by bending the wire to circular form during simultaneous twisting, comprising a wire conveying means and a consecutively arranged laying head including a rotating laying pipe, whose central axis is oriented tangentially to the wire axis on the wire entry end and which gradually passes over from the entry end into a circular arc directed approximately perpendicular to the axis of rotation, its center lying on the axis of rotation, wherein a twisting device is provided between the wire conveying means and the laying head.

To lay hot rolled wire in the flat in approximately circular windings on a roller table, it is known to use a laying head (U.S. Pat. No. 4,765,556). A laying head comprises a three dimensionally curved laying pipe, through which the wire is guided. The laying pipe, thus, forms a path which the wire is constrained to follow.

The laying pipe rotates about an axis constituting a tangent to the central line of the laying pipe. The wire conveyed from the wire block or wire train or by means of a separate driving aggregate runs straight into the laying pipe entry in the sense of this tangent. The other end of the laying pipe approximately has the shape of a circular arc. This circular arc is located in a plane extending approximately perpendicular to the axis of rotation of the laying pipe. The center of the circular arc lies on the axis of rotation. The wire bent to circular windings exits from this laying pipe end.

The angular speed at which the laying pipe rotates is chosen such that the extents of the circumferential speed of the laying pipe end forming a circular arc and of the speed of the entering wire are equal in value. The rotational direction of the laying pipe is chosen such that the absolute speed of the exiting wire becomes zero. Thus, standing wire loops are formed on the laying head end, which tilt under the influence of gravity and usually are conveyed to a coil build-up chamber on an air cooling roller table.

With certain wire grades, wire diameters and wire temperatures, the elastic resilience of the wire results in the wire leaving the laying pipe not in tightly adjacent windings, but by forming a helix upon exiting from the laying head, with such a high pitch that the individual windings do not tilt any longer, thus rendering further transportation of the wire and further processing to coiled forms in the coil build-up chamber impossible. Such a helix is formed by torsional springback of the wire as a result of its elastoplastic behavior. With large wire diameters, the pitch of the helix which also depends on the shape of the laying pipe, may happen to be larger than the winding diameter of the wire.

In order to avoid these disadvantages, it is known from DD Patent No. 109,329 to displace the twist back to the wire portion present between the final rolling stand and the driver. With an arrangement of the initially defined kind, this is obtained by arranging a driver in front of the laying means, whose driving disc axles are staggered. In doing so, each driving disc with its bearing is arranged to be adjustable perpendicularly to the wire direction by an angle of up to 3°.

The invention has as its object to provide an arrangement of the initially defined kind as well as a method by which it is possible to lay in windings wires that cannot be laid any longer because of their elastic resilience as a result of material behavior and the size of the wire diameter (in particular, ranging between 10 and 25 mm), wherein the wire screw leaving the laying head only has a slight pitch such that the wire windings are closely adjacent. In particular, it is to be possible to vary the pitch of the wire screw as desired.

With an arrangement of the initially defined kind, this object is achieved in that the twisting device is formed by a bent pipe twisting the wire under positive locking and frictional engagement.

The function of the wire conveying means may be assumed by the wire block or the wire train or by a separate, additional device provided between the wire block and the laying head; it may prove necessary, in particular when laying wires with large diameters, to provide an additional wire conveying means between the twisting means and the laying head.

Preferably, the entry end and the delivery end of the pipe register with the axis of rotation of the laying head, the pipe being settable in rotation about the axis of rotation of the laying head. The axes of rotation of the laying head and of the device for pre-twisting also may be inclined relative to each other. Nor need the twisting device and the laying head be arranged to immediately follow each other.

An embodiment of particularly simple configuration is characterized in that the bent pipe is designed like a U.

An arrangement that allows for twisting of the wire in a first stage of treatment by performing only a slight portion of the bending work otherwise necessary is characterized in that the bent pipe is designed as a loop bent by 360°.

Suitably, the bent pipe is drivable at an angular speed larger than, or equal to, that of the laying pipe of the laying head in a second stage of treatment.

Advantageously, the angular speed of the bent pipe is variably adjustable, whereby it is possible to vary the pitch of the wire screw exiting the laying head, e.g., to adjust it to a predetermined value or to adapt it to operational conditions changing during laying in windings.

In principal, the ratio of the angular speeds in the first stage relative to the second stage depends on the material behavior, the wire diameter and on the diameter of the windings laid.

Advantageously, the ratio of the angular speed of the bent pipe to the angular speed of the laying pipe of the laying head ranges between 2.5 to 1 and 4 to 1.

A preferred method of laying a wire in circular windings by using an arrangement according to the invention is characterized in that the additional twist is realized at an angular speed larger than that of the bending twist.

Figure 2:
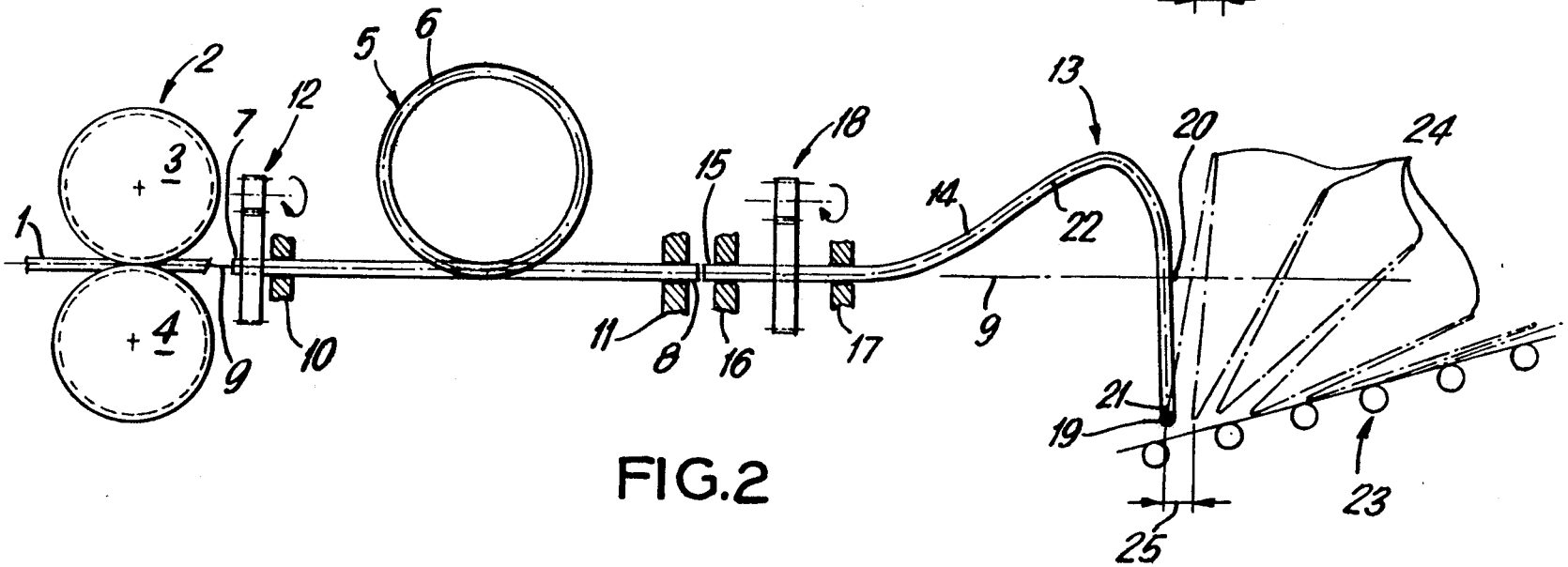

In the following, the invention will be explained in more detail by way of two exemplary embodiments and with reference to the accompanying drawings, wherein:

FIG. 1 is a schematically illustrated side view according to a first embodiment; and FIG. 2 represents a second embodiment in an illustration analogous to FIG. 1.

The hot wire 1 fed from a wire block (not illustrated) is supplied to a twisting device 5 by a wire conveying means 2 comprised of two oppositely arranged driven rolls 3, 4. The twisting device 5 which is offset from the wire axis 9 is formed by a U-shaped bent pipe 6 whose entry end 7 and delivery end 8 are aligned to approximately register with the wire axis 9 defined by the wire conveying means 2. The pipe 6 is mounted in bearings 10, 11 on its aligned ends 7, 8 and is drivable by means of a drive 12. The internal diameter of the pipe 6 is slightly larger than the diameter of the wire.

A conventional laying head 13 is provided to follow the twisting device 5 and is formed by a three dimensionally bent laying pipe 14, which is rotatable about the straight wire axis 9. The end 15 of the laying pipe 14, at which the wire 1 enters, is aligned to approximately register with the straight wire axis 9 defined by the wire conveying means 2 and is mounted on this end by means of bearings 16, 17 so as to be rotatable on a machine frame (not illustrated). In addition, this end 15 is coupled to a driving means 18.

The other end 19 of the laying pipe 14 is designed as a circular arc, the center 20 of the circular arc 21 being located on the axis of rotation of the laying pipe 14 or on the straight wire axis 9 identical therewith. Between the two ends 15 and 19, the laying pipe 14 has a shape 22 gradually passing over from the axis 9 into the circular arc 21.

In the conveying direction of the wire 1, a roller table 23 is provided after the laying pipe 14, on which the wire windings 24 come to rest. On this roller table 23, the wire 1 is cooled and transported to a consecutively arranged coil build-up chamber.

The twisting device 5 arranged upstream of the laying pipe 14 rotates at a preselected angular speed such that the wire enters the laying pipe 14 already at a predetermined twist. Thereby, the torsional work applied in total on the wire 1 can be increased to such an extent that the wire windings 24 come to lie quite closely adjacent, i.e., at a slight pitch of the helix formed by the wire windings 24, and further transportation by the roller table 23 and coil build-up may be realized without any difficulty.

The angular speed of the pipe 6 of the twisting device 5 is chosen to be larger than that of the laying pipe 14. By varying the ratio of the angular speed of the pipe 6 of the twisting device 5 and of that of the laying pipe 14, the pitch 25 of the helix formed by the wire windings 24 may be varied such that it will be possible to adjust a very small predetermined pitch 25, which preferably corresponds to the diameter of the wire in its value or only is slightly larger than the same.

According to the embodiment illustrated in FIG. 2, the pipe 6 of the twisting device 5 is designed as a torsional loop extending over 360°. This embodiment has the advantage that the bending work to be performed by the twisting device 5 is little.

The invention is not limited to the exemplary embodiments illustrated, but may be modified in various aspects. Thus, it is, for instance, possible to vary the the shape of the pipe 6 of the twisting device 5.

What we claim is:

1. In an arrangement to be used for laying a wire in circular windings by bending said wire in circular form while simultaneously twisting said wire and of the type including a wire conveying means adapted to convey a wire having a wire axis, a laying head arranged downstream of said wire conveying means, said laying head including a rotating laying pipe adapted to rotate about an axis of rotation and having an entry end, a delivery end and a central axis oriented tangentially to said wire axis on said entry end, said rotating laying pipe gradually passing over from said entry end into a circular arc directed approximately perpendicular to said axis of rotation and having its center lying on said axis of rotation, and a twisting means provided between said wire conveying means and said laying head, the improvement wherein said twisting means is comprised of a bent pipe constructed and arranged to twist said wire under positive locking and frictional engagement.

2. An arrangement as set forth in claim 1, wherein said bent pipe has a bent pipe entry end and a bent pipe delivery end approximately registering with said axis of rotation of said laying head, said bent pipe being settable in rotation about said axis of rotation of said laying head.

3. An arrangement as set forth in claim 1, wherein said bent pipe is designed like a U.

4. An arrangement as set forth in claim 1, wherein said bent pipe is designed as a loop bent by 360°.

5. An arrangement as set forth in claim 1, wherein said bent pipe is drivable at an angular speed larger than, or equal to, the angular speed of said laying pipe of said laying head.

6. An arrangement as set forth in claim 5, wherein said angular speed of said bent pipe is variably adjustable.

7. An arrangement as set forth in claim 5, wherein the ratio of the angular speed of said bent pipe to the angular speed of said laying pipe of said laying head ranges between 2.5 and 4.

8. A method of laying wire in the form of circular windings, which comprises;

feeding wire continuously along its axis and causing said wire in a first stage of treatment to enter a constrained circular arc path offset from the wire axis and rotating said circular arc path about the wire axis while simultaneously twisting said wire as the wire passes therethrough;

causing said twisted wire as it leaves the rotating constrained circular path to enter in a second stage of treatment by passing through a constrained bend-twisting path in the shape of a circular arc while rotating said circular arc path around said wire axis; and allowing said continuously moving wire to leave said bend-twisting path in the form of tightly adjacent windings by controlling the rotational speed during the first stage relative to the rotational speed in the second stage.

9. The method of claim 8, wherein the rotational speed in the first stage is greater than that in the second stage.

10. The method of claim 8, wherein the rotational speed in the first stage ranges between about 2.5 to 1 to 4 to 1.

11. The method of claim 8, wherein the constrained circular arc path in the first stage is in the form of a 360° loop.

12. The method of claim 8, wherein the constrained circular path in the second stage is substantially U-shaped.

* * * * *